US009726341B2

(12) United States Patent
Kanayama et al.

(10) Patent No.: US 9,726,341 B2
(45) Date of Patent: Aug. 8, 2017

(54) LIGHTING APPARATUS AND MOTOR VEHICLE

(71) Applicant: PANASONIC INTELLECTUAL PROPERTY MANAGEMENT CO., LTD., Osaka (JP)

(72) Inventors: Yoshihiko Kanayama, Hyogo (JP); Tomoyuki Nakano, Osaka (JP); Tomoyuki Ogata, Osaka (JP); Masaaki Ito, Osaka (JP); Toshiro Omuro, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 83 days.

(21) Appl. No.: 14/819,528

(22) Filed: Aug. 6, 2015

(65) Prior Publication Data

US 2016/0061402 A1 Mar. 3, 2016

(30) Foreign Application Priority Data

Aug. 29, 2014 (JP) ..... 2014-175670

(51) Int. Cl.

| | |
|---|---|
| ***F21V 5/04*** | (2006.01) |
| ***F21S 8/10*** | (2006.01) |
| ***F21V 5/00*** | (2015.01) |

(52) U.S. Cl.

CPC ..... *F21S 48/1747* (2013.01); *F21S 48/1154* (2013.01); *F21S 48/1159* (2013.01);

(Continued)

(58) Field of Classification Search

CPC ..... F21S 48/1747; F21S 48/1154; F21S 48/1159; F21S 48/1216; F21S 48/1225;

(Continued)

(56) References Cited

U.S. PATENT DOCUMENTS 6,776,513 B2 * 8/2004 Albou ..... B60Q 1/0041 362/242
8,123,388 B2 * 2/2012 Ookubo ..... F21S 48/1154 362/512

(Continued)

FOREIGN PATENT DOCUMENTS

| | | | |
|---|---|---|---|
| CN | 105090852 | 11/2015 | |
| FR | EP 2505911 A2 * | 10/2012 | ..... B60Q 1/0052 |
| JP | 2013-101881 | 5/2013 | |

OTHER PUBLICATIONS

European Patent Office, Patent Translate Description EP2505911, Dec. 27, 2016, pp. 1-11.*

Office Action issued in China Counterpart Patent Appl. No. 201510511163.0, dated May 3, 2017 , along with an English translation thereof.

*Primary Examiner* — Alan Cariaso

(74) *Attorney, Agent, or Firm* — Greenblum & Bernstein, P.L.C.

(57) ABSTRACT

A lighting apparatus includes: a first light source that emits a first light; a first lens that allows the first light to pass through and exit from a first exit face of the first lens; a second light source that emits a second light; and a second lens that is smaller than the first lens and allows the second light to pass through and exit from a second exit face of the second lens. When viewed from the first exit face side: (i) the first exit face has a recess that is recessed inward from a periphery of the first exit face; and (ii) the second exit face is at least partially disposed in the recess.

18 Claims, 10 Drawing Sheets

(52) U.S. Cl.
CPC ..... *F21S 48/125* (2013.01); *F21S 48/1216* (2013.01); *F21S 48/1225* (2013.01); *F21S 48/1258* (2013.01); *F21S 48/1275* (2013.01); *F21S 48/1329* (2013.01); *F21S 48/1364* (2013.01); *F21S 48/14* (2013.01); *F21S 48/328* (2013.01); *F21V 5/007* (2013.01)

(58) Field of Classification Search
CPC .. F21S 48/125; F21S 48/1258; F21S 48/1329; F21S 48/1364; F21S 48/14; F21S 48/1275; F21S 48/328; F21V 5/007
See application file for complete search history.

(56) References Cited

U.S. PATENT DOCUMENTS

| | | | | |
|---|---|---|---|---|
| 8,746,940 | B2 | 6/2014 | Kawanobe et al. | |
| 9,285,090 | B2 * | 3/2016 | Hsu | F21S 48/1154 |
| 2012/0031467 | A1 | 2/2012 | Schmaelzle et al. | |
| 2012/0134167 | A1 * | 5/2012 | Huang | B60Q 1/0041 362/519 |
| 2013/0114283 | A1 | 5/2013 | Kawanobe et al. | |
| 2014/0226355 | A1 * | 8/2014 | Blandin | F21S 48/1109 362/520 |
| 2014/0268856 | A1 | 9/2014 | Kawanobe et al. | |
| 2015/0138822 | A1 * | 5/2015 | Tatsukawa | F21S 48/1159 362/516 |
| 2015/0323147 | A1 | 11/2015 | Kanayama et al. | |

* cited by examiner

LIGHTING APPARATUS AND MOTOR VEHICLE

CROSS REFERENCE TO RELATED APPLICATION

This application claims the benefit of priority of Japanese Patent Application Number 2014-175670, filed Aug. 29, 2014, the entire content of which is hereby incorporated by reference.

BACKGROUND OF THE INVENTION

1. Field of the Invention

The present disclosure relates to a lighting apparatus and a motor vehicle including the lighting apparatus.

2. Description of the Related Art

Headlights such as headlamps are disposed in the front portion of vehicles such as a motor vehicle. A headlight includes a housing (case) and a lighting apparatus attached to the housing.

For example, a headlight described in Japanese Unexamined Patent Application No. 2013-101881 (Patent Literature (PTL) 1) is known as a vehicle headlight. The headlight described in PTL 1 includes a first lamp unit that mainly illuminates in a forward and downward direction from the vehicle, and a second lamp unit that mainly illuminates the area far ahead of the vehicle. In PTL 1, the first lamp unit is turned ON during short-distance illumination, and the first lamp unit and the second lamp unit are turned on during long-distance illumination.

SUMMARY OF THE INVENTION

In the aforementioned conventional headlight, during long-distance illumination, light is emitted forward of the vehicle from each of the first lamp unit and the second lamp unit. This may make a person located in the illuminated area uncomfortable.

Specifically, the intensity of light emitted from each of the first lamp unit and the second lamp unit is different. Therefore, a person who is subjected to these lights is not only exposed to glare from the more-intense light but may also recognize the less-intense light and feel very uncomfortable. Furthermore, when light intensity and light color are different, the discomfort felt by the person becomes stronger.

Furthermore, since the area illuminated by the lights is equivalent to the traveling course of the vehicle, the person or the driver of the vehicle must take action to avoid the car or the person, respectively. However, since the person feels discomfort, the danger avoidance behavior of the person may be compromised and the person may not be able to move away from the area.

In view of this, the present disclosure has an object to provide a lighting apparatus capable of reducing the discomfort imparted to a person in the illumination area, and a motor vehicle including the lighting apparatus.

In order to achieve the aforementioned object, a lighting apparatus according to an aspect of the present disclosure includes: a first light source that emits a first light; a first lens that allows the first light to pass through and exit from a first exit face of the first lens; a second light source that emits a second light; and a second lens that is smaller than the first lens and allows the second light to pass through and exit from a second exit face of the second lens, wherein, when viewed from a first exit face side: (i) the first exit face has a recess that is recessed inward from a periphery of the first exit face; and (ii) the second exit face is at least partially disposed in the recess.

According to the present disclosure, it is possible to reduce the discomfort imparted to a person located in the illuminated area.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE PREFERRED EMBODIMENTS

Hereinafter, a lighting apparatus and a motor vehicle according to exemplary embodiments in the present disclosure shall be described in detail with reference to the drawings. It should be noted that each of the subsequently-described exemplary embodiments show a specific preferred example of the present disclosure. Therefore, numerical values, shapes, materials, structural components, the arrangement and connection of the structural components, etc. shown in the following exemplary embodiments are mere examples, and are not intended to limit the scope of the present disclosure. Furthermore, among the structural components in the following exemplary embodiments, components not recited in any one of the independent claims which indicate the broadest concepts of the present disclosure are described as arbitrary structural components.

Hereinafter, in this disclosure, "front/forward" refers to the direction in which light is emitted from the lighting apparatus (i.e., the light-emitting direction) and the light-extraction direction in which light is extracted, and "back/behind" refers to the direction opposite the "front/forward" direction. Furthermore, "forward" refers to the traveling direction when the motor vehicle is advancing; the ceiling side of the motor vehicle is "upward" or "top side" refer to, and the opposite side is "downward" or "bottom side". Furthermore, the forward-backward direction is referred to as the Z-axis direction, the up-down direction (vertical direction) is referred to as the Y-axis direction, and the left-right direction (horizontal direction) is referred to as the X-axis direction.

Furthermore, the respective figures are schematic diagrams and are not necessarily precise illustrations. In addition, in the respective diagrams, identical structural components are given the same reference signs.

Embodiment 1

[Motor Vehicle]

Figure 1:
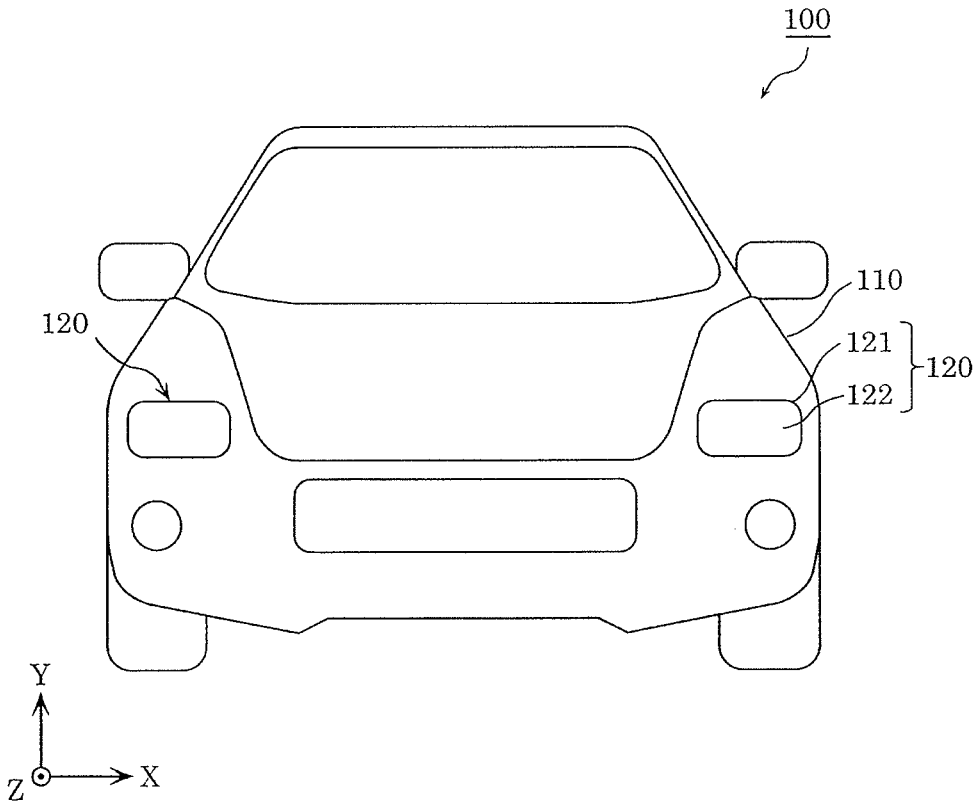
FIG. 1 is a front view of a motor vehicle according to Embodiment 1 of the present disclosure.

First, motor vehicle 100 according to this embodiment will be described using FIG. 1. FIG. 1 is a front view of motor vehicle 100 according to this embodiment.

As illustrated in FIG. 1, motor vehicle 100 in this embodiment is an example of a vehicle such as a four-wheeled motor vehicle, and includes vehicle body 110, and headlights 120 disposed on the left and right portions of the front of vehicle body 110. Motor vehicle 100 is, for example, a gasoline-powered motor vehicle driven by a gasoline engine, an electric motor vehicle driven by an electric motor, etc.

Each of headlights 120 is a lamp, and, in this embodiment, is a headlamp used in a vehicle (i.e., a vehicle headlamp). Headlight 120 includes housing 121, front face cover 122, and a lighting apparatus (not illustrated) attached behind front face cover 122.

Housing 121 is, for example, a metal case and has an opening for emitting light from the lighting apparatus. Front face cover 122 is a light-transmissive headlamp cover, and is provided to the opening of housing 121. Housing 121 and front face cover 122 are sealed to prevent water and dust from entering inside housing 121.

The lighting apparatus is disposed behind front face cover 122 and attached to housing 121. Light emitted from the lighting apparatus passes through front face cover 122 and is emitted to the outside.

[Lighting Apparatus]

Next, lighting apparatus 1 according to this embodiment will be described using FIG. 2 to FIG. 5.

Figure 2:
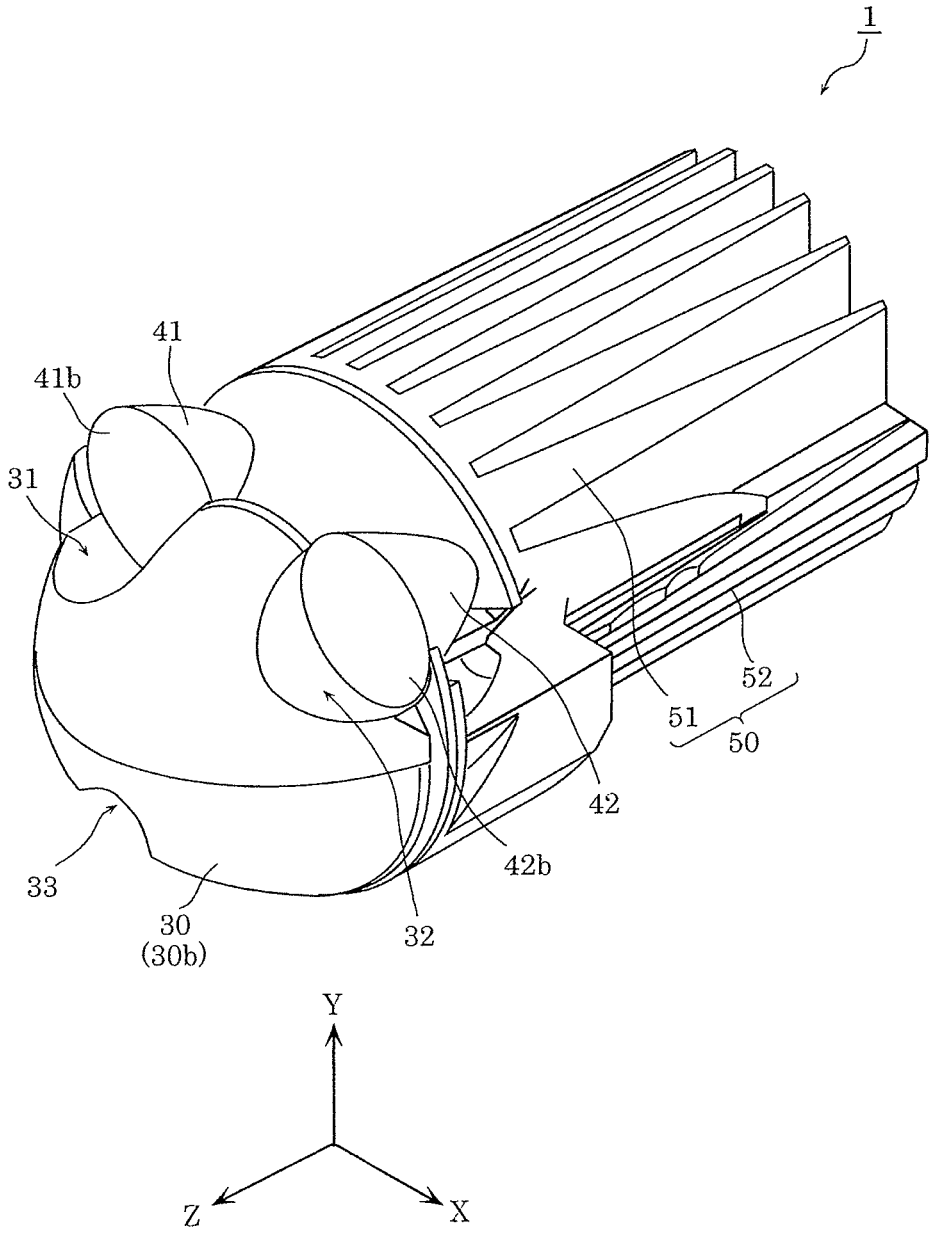
FIG. 2 is an outline perspective view of a lighting apparatus according to Embodiment 1 of the present disclosure.
Figure 3:
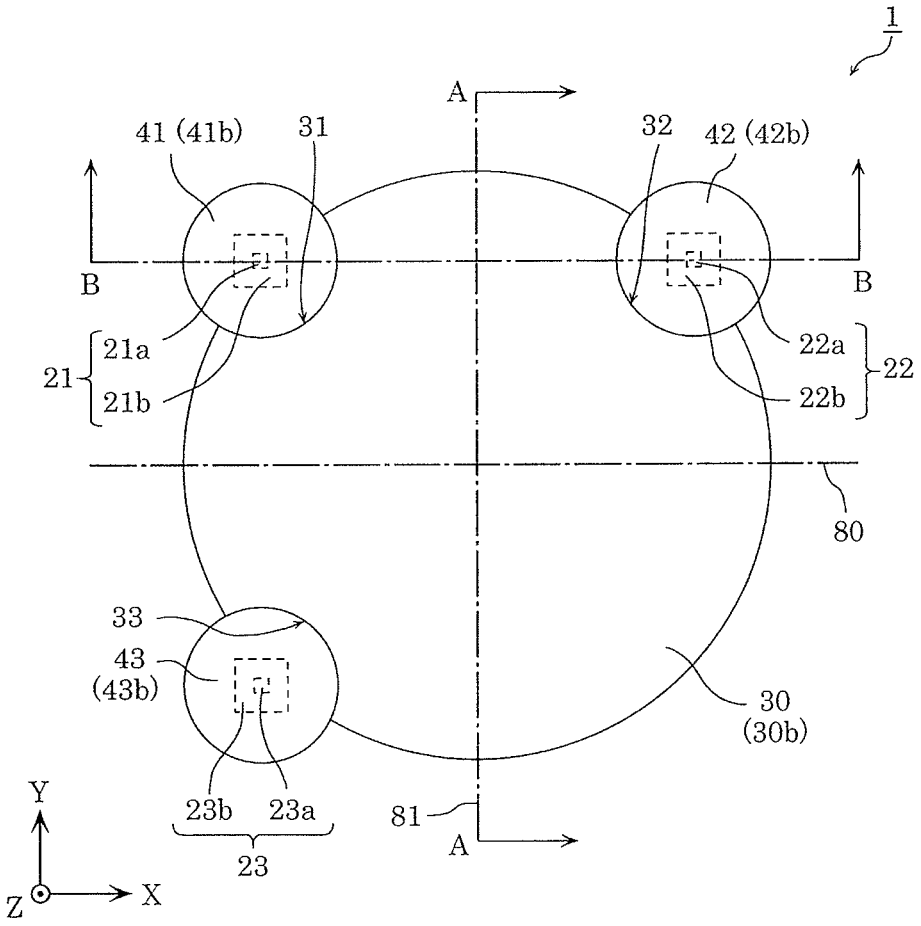
FIG. 3 is a front view of the lighting apparatus according to Embodiment 1 of the present disclosure.
Figure 4:
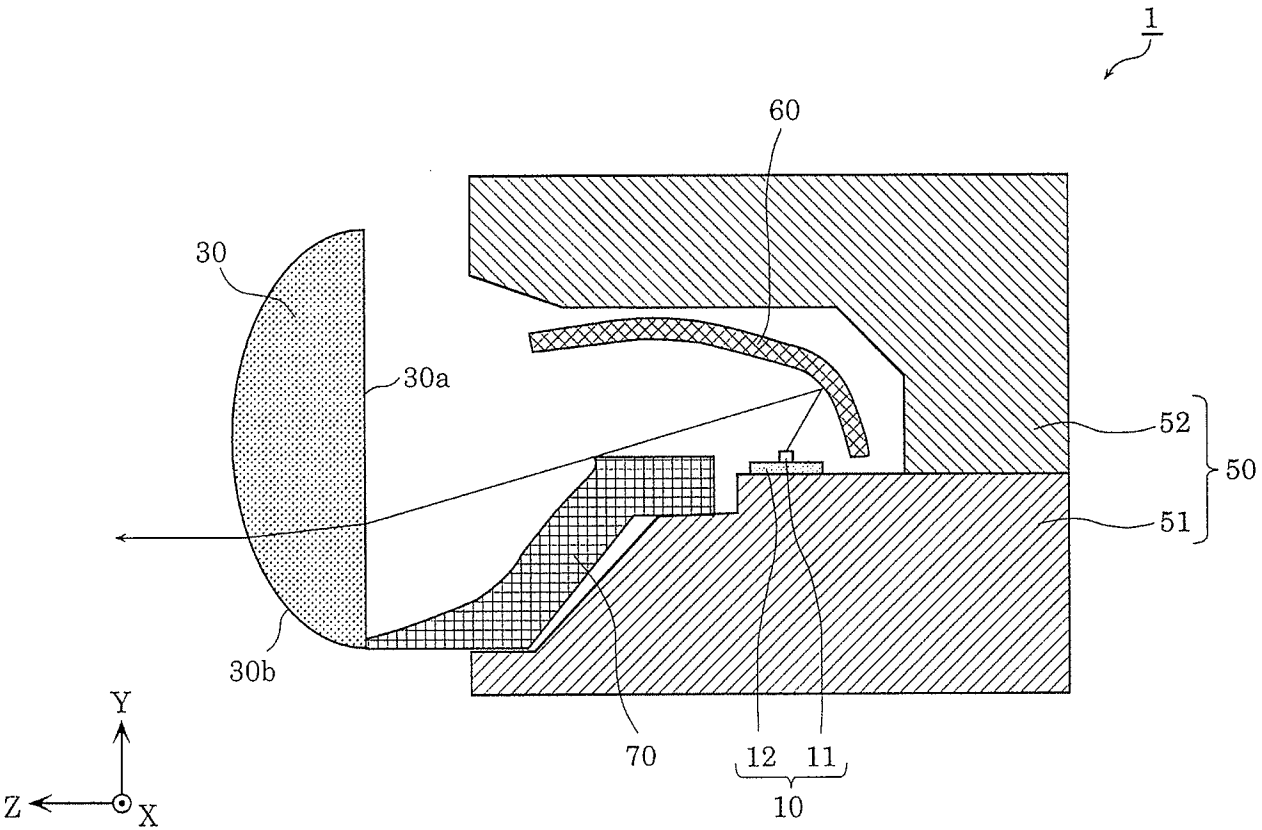
FIG. 4 is a cross-sectional view of the lighting apparatus according to Embodiment 1, taken along line A-A in FIG. 3.
Figure 5:
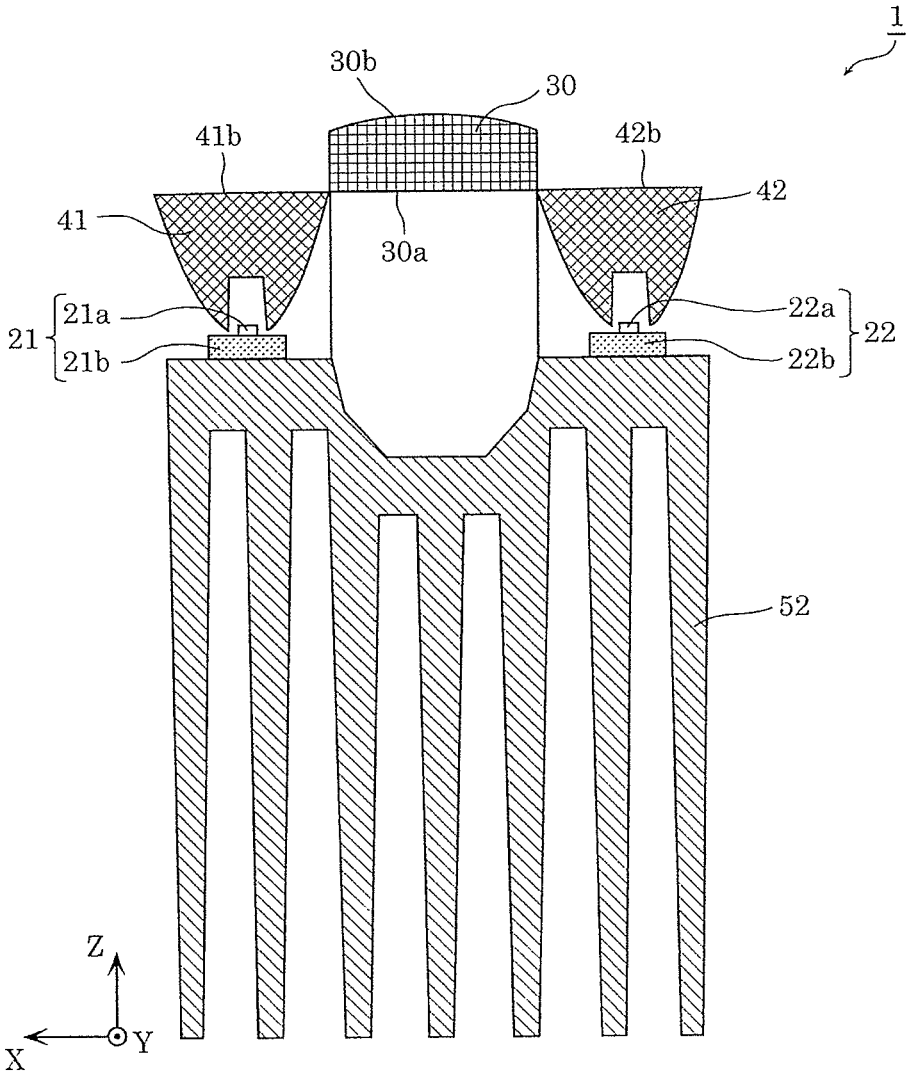
FIG. 5 is a cross-sectional view of the lighting apparatus according to Embodiment 1, taken along line B-B in FIG. 3.

FIG. 2 is a perspective view of lighting apparatus 1 according to this embodiment. FIG. 3 is a front view of lighting apparatus 1 according to this embodiment. FIG. 4 is cross-sectional view of lighting apparatus 1 according to this embodiment, taken along line A-A in FIG. 3. FIG. 5 is cross-sectional view of lighting apparatus 1 according to this embodiment, taken along line B-B in FIG. 3.

Lighting apparatus 1 is, for example, a vehicle lighting apparatus that is used in a vehicle headlamp. In this embodiment, lighting apparatus 1 emits light forward of vehicle body 110 illustrated in FIG. 1. Specifically, lighting apparatus 1 is a projector-type headlamp.

As illustrated in FIG. 2 to FIG. 5, lighting apparatus 1 includes, as a lamp main body, low beam light source module 10, three high beam light source modules 21 to 23, low beam lens 30, three high beam lenses 41 to 43, heat dissipator 50, reflector 60, and shield 70. In addition, lighting apparatus 1 includes a lighting control unit (not illustrated) that controls low beam light source module 10 and high beam light source modules 21 to 23.

Lighting apparatus 1 according to this embodiment is an integrated lamp capable of emitting a high beam which is a running beam and a low beam which is a passing beam. Specifically, low beam lens 30 and high beam lenses 41 to 43 are configured to fit a certain circular region when viewed from the Z-axis direction. For example, low beam lens 30 and high beam lenses 41 to 43 are configured to fit within ϕ (phi) 70 mm.

In addition, many other structural components are not illustrated in FIG. 3 in order to make the positional relationship between low beam lens 30 and the three high beam lenses 41 to 43 easier to understand.

Details of the respective structural components are described below.

[Low Beam Light Source Module]

Low beam light source module 10 is an example of a first light source that emits a short-distance illumination light (first light). Low beam light source module 10 is a light source for forming a low beam. Specifically, low beam light source module 10 is a low beam forming light emitting diode (LED) module, and is turned ON when illuminating an area, specifically the road, forward and downward of vehicle body 110.

Low beam light source module 10 is turned ON at night or when the surrounding environment is dark such as in a tunnel. Specifically, low beam light source module 10 is turned ON not only when emitting a low beam (during short-distance illumination) but also when emitting a high beam (during long-distance illumination). In other words, in this embodiment, a high beam is formed by the light emitted from low beam light source module 10 and the light emitted from each of high beam light source modules 21 to 23.

Low beam light source module 10 is a white light source, and is, for example, a B-Y type white LED light source that emits white light by using a yellow phosphor and a blue LED chip that emits blue light. Alternatively, low beam light source module 10 may be a white LED light source that emits white light by using LED chips that emit blue light, red light, and green light, respectively. Low beam light source module 10 emits light equivalent to 20 W, for example.

As illustrated in FIG. 4, low beam light source module 10 includes low beam light-emitting element 11, and board 12 on which low beam light-emitting element 11 is mounted.

Low beam light source module 10 may have either a surface mount device (SMD) structure or a chip on board (COB) structure.

In the case of the SMD structure, low beam light-emitting element 11 is, for example, an SMD-type LED element in which an LED chip (bare chip) is mounted inside a resin container and sealed using a sealing component (for example, a resin containing a phosphor). On the other hand, in the case of the COB structure, low beam light-emitting element 11 is the LED chip (bare chip) itself, and the LED chip is directly mounted on board 12. In this case, the LED chip mounted on board 12 is sealed using a sealing component such as a resin containing a phosphor.

Low beam light-emitting element 11 is a light-emitting element that emits light which passes through low beam lens 30. For example, low beam light-emitting element 11 emits light not only when lighting apparatus 1 emits a low beam but also when lighting apparatus 1 emits a high beam.

Board 12 is, for example, a ceramic board made of ceramic such as alumina, or the like, a resin board made of a resin, or a metal-based board having a metal as a base which is insulation-coated, etc. Furthermore, the plan view shape of board 12 can be a shape that conforms with the shape of the placement face of heat dissipator 50 on which board 12 is to be placed.

Low beam light source module 10 is fixed to first heat sink 51 of heat dissipator 50. Specifically, board 12 is placed on and fixed to a predetermined placement surface of first heat sink 51. In this embodiment, board 12 is disposed laterally (horizontally) so that low beam light source module 10 emits light upward, as illustrated in FIG. 4. In other words, the optical axis of low beam light source module 10 (low beam light-emitting element 11) is parallel to the Y-axis.

[High Beam Light Source Module]

Each of high beam light source modules 21 to 23 is an example of a second light source that emits a light (second light) for long-distance illumination. High beam light source modules 21 to 23 are light sources for forming a high beam. Specifically, high beam light source modules 21 to 23 are high beam forming LED modules, and are turned ON when illuminating a distant area forward of vehicle body 110.

High beam light source modules 21 to 23 are turned ON at night or when the surrounding environment is dark such as in a tunnel and there are no on-coining vehicles on the opposite lane. Specifically, high beam light source modules 21 to 23 are turned ON when a high beam is emitted.

Each of high beam light source modules 21 to 23 is a white light source, and is, for example, a B—Y type white LED light source that emits white light by using a yellow phosphor and a blue LED chip that emits blue light. Alternatively, each of high beam light source modules 21 to 23 may be a white LED light source that emits white light by using LED chips that emit blue light, red light, and green light, respectively. It should be noted that high beam light source modules 21 to 23 may emit lights of the same color and intensity, or may emit lights of mutually different color and intensity.

High beam light source modules 21 to 23 emit light equivalent to a total of 10 to 15 W, for example. In other words, the intensity of light of each of high beam light source modules 21 to 23 is less than the intensity of light of low beam light source module 10.

As illustrated in FIG. 3 and FIG. 5, high beam light source module 21 includes high beam light-emitting element 21*a* and board 21*b* on which high beam light-emitting element 21*a* is mounted. In the same manner, high beam light source module 22 includes high beam light-emitting element 22*a* and board 22*b* on which high beam light-emitting element 22*a* is mounted. High beam light source module 23 includes high beam light-emitting element 23*a* and board 23*b* on which high beam light-emitting element 23*a* is mounted.

Each of high beam light source modules 21 to 23 may have either the SMD structure or the COB structure. Details of the SMD structure and the COB structure are the same as in the case of low beam light source module 10.

High beam light source modules 21 to 23 are arranged corresponding to high beam lenses 41 to 43, respectively. Specifically, high beam light-emitting element 21*a* emits light which passes through high beam lens 41. High beam light-emitting element 22*a* emits light which passes through high beam lens 42. High beam light-emitting element 23*a* emits light which passes through high beam lens 43. For example, high beam light source modules 21*a* to 23*a* emit light when lighting apparatus 1 emits a high beam.

Each of hoards 21*b* to 23*b* is, for example, a ceramic board made of ceramic such as alumina, or the like, a resin board made of a resin, or a metal-based board having a metal as a base which is insulation-coated, etc. Furthermore, the plan view shape of boards 21*b* to 23*b* can be a shape that conforms with the shape of the placement face of heat dissipator 50 on which each of boards 21*b* to 23*b* is to be placed.

High beam light source modules 21 to 23 are fixed to second heat sink 52 of heat dissipator 50. Specifically, each of boards 21*b* to 23*b* is placed on and fixed to a predetermined placement face of second heat sink 52. In this embodiment, boards 21*b* to 23*b* are disposed upright (vertically) so that high beam light source modules 21 to 23 emit light forward, as illustrated in FIG. 5. In other words, the optical axis of each of high beam light source modules 21 to 23 (high beam light-emitting elements 21*a* to 23*a*) is parallel to the Z-axis.

[Low Beam Lens]

Low beam lens 30 is an example of a first lens that allows light emitted from low beam light source module 10 to pass through and exit from exit face 30*b* (first exit face). Low beam lens 30 is disposed in front of low beam light source module 10 and shield 70. Low beam lens 30 is positioned by being fixed to, for example, shield 70 (or first heat sink 51).

Low beam lens 30 has entry face 30*a* and exit face 30*b*. Taking low beam lens 30 as reference, entry face 30*a* is a main face on the low beam light source module 10 side, that is, a back-side main face, and is, for example, flat as illustrated in FIG. 4 and FIG. 5. Exit face 30*b* is a front-side main face and is, for example, a portion of a spherical or ellipsoidal lateral face. As illustrated in FIG. 4, the light emitted from low beam light source module 10 is reflected by reflector 60 and then enters low beam lens 30 from entry face 30*a*, passes through low beam lens 30, and exits from exit face 30*b*.

Low beam lens 30 can be fabricated by injection molding, etc. using a transparent resin such as an acrylic, polycarbonate, or cyclic olefin resin. For example, low beam lens 30 is a portion of a sphere or an ellipsoid. Low beam lens 30 and high beam lenses 41 to 43 are configured as separate bodies.

The plan view shape of low beam lens 30 and its positional relationship to high beam lenses 41 to 43 is described later.

[High Beam Lens]

Each of high beam lenses 41 to 43 is an example of a second lens that allows light emitted from the corresponding one of high beam light source modules 21 to 23 to pass through and exit from the corresponding one of exit faces 41*b* to 43*b* (second exit faces). High beam lenses 41 to 43 correspond to and are disposed in front of high beam light source modules 21 to 23, respectively.

Each of high beam lenses 41 to 43 is what is called a collimating lens that converts incident light rays into parallel light rays. The rays of light emitted from each of high beam light source modules 21 to 23 are converted into parallel light rays, and travel forward from the corresponding one of exit faces 41*b* to 43*b*. High beam lenses 41 to 43 are positioned by being fixed to second heat sink 52, for example.

High beam lenses 41 to 43 have exit faces 41*b* to 43*b*, respectively. Exit faces 41*b* to 43*b* are the forward end faces of high beam lenses 41 to 43, respectively, and are, for example, flat as illustrated in FIG. 5. As illustrated in FIG. 3, the plan view shape of each of exit faces 41*b* to 43*b* is substantially circular.

High beam lenses 41 to 43 can be fabricated by injection molding, etc. using a transparent resin such as an acrylic, polycarbonate, or cyclic olefin resin. Specifically, each of high beam lenses 41 to 43 has a truncated conical shape with a diameter that increases toward the front. High beam light source modules 21 to 23 are disposed on the small diameter portion (back) sides of high beam lenses 41 to 43, respectively.

With this, the light emitted from each of high beam light-emitting elements 21*a* to 23*a* is totally reflected off the truncated conical and curved peripheral face of the corresponding one of high beam lenses 41 to 43 to become collimated light, and the collimated light is emitted forward from the corresponding one of exit faces 41*b* to 43*b*.

Furthermore, each of high beam lenses 41 to 43 is smaller than low beam lens 30. Specifically, exit faces 41*b* to 43*b* of high beam lenses 41 to 43 are smaller than exit face 30*b* of low beam lens 30. For example, as illustrated in FIG. 3, when viewed from the exit face 30*h* side, the surface area of each of exit faces 41*b* to 43*b* is smaller than the surface area of exit face 30*b*.

[Heat Dissipator]

Heat dissipator 50 is a heat-dissipating component for dissipating heat generated in low beam light source module 10 and high beam light source modules 21 to 23 to the outside (i.e., the surrounding air). Therefore, heat dissipator 50 may be formed using a material having high thermal conductivity such as metal. Heat dissipator 50 is, for example, made of die-cast aluminum which uses an aluminum alloy.

As illustrated in FIG. 4, heat dissipator 50 is divided into two, namely, first heat sink 51 and second heat sink 52. In other words, first heat sink 51 and second heat sink 52 are combined and integrated to form heat dissipator 50. Plural heat radiation fins are provided in each of first heat sink 51 and second heat sink 52.

First heat sink 51 is a heat-dissipating component for dissipating heat generated mainly in low beam light source module 10 (low beam light-emitting element 11). The placement face (setting face) for placing low beam light source module 10 is provided in first heat sink 51.

Second heat sink 52 is a heat-dissipating component for dissipating heat generated mainly in high beam light source modules 21 to 23 (high beam light-emitting elements 21*a* to 23*a*). The placement faces (setting faces) for placing high beam light source modules 21 to 23 are provided in second heat sink 52.

[Reflector]

Reflector 60 is disposed inside heat dissipator 50, above low beam light source module 10. Reflector 60 has a curved reflecting face that reflects light emitted upward from low beam light source module 10 forward and obliquely downward and thereby causes the reflected light to enter low beam lens 30.

For example, reflector 60 is formed by resin molding using a heat-resistant resin, and the surface of reflector 60 is made into a mirror surface. For example, reflector 60 is formed by forming a metal vapor-deposited film (for example, an aluminum vapor-deposited film) on a portion of the surface of the resin molded body that forms reflector 60. It should be noted that reflector 60 may be integrally formed with heat dissipator 50. In other words, reflector 60 may be a part that is formed by making a portion of the inner face of heat dissipator 50 into a mirror surface.

[Shield]

Shield 70 is a structure for forming a cut-off line, which is a predetermined light-dark boundary, by blocking a portion of the light emitted from low beam light source module 10. Shield 70 is provided inside heat dissipator 50. Shield 70 can be formed, for example, by resin molding using a heat-resistant resin. It should be noted that shield 70 need not be made of resin, and may be made of metal. For example, shield 70 may be integrally formed with heat dissipator 50.

[Lens Arrangement]

Next, the positional relationship between low beam lens 30 and high beam lenses 41 to 43 according to this embodiment is described using FIG. 3 and FIG. 5.

As illustrated in FIG. 3, the shape of exit face 30*b* is substantially circular when viewed from the exit face 30*b* side. It should be noted that the expression "when viewed from the exit face 30*b* side" specifically means "when viewed from the front of lighting apparatus 1". In the subsequent description, there are cases where the expression "when viewed from the exit face 30*b* side" is simply described as "front view". In the front view, exit face 30*b* has three recesses 31 to 33. The three recesses 31 to 33 are recessed inward from the periphery of exit face 30*b*.

Each of high beam lenses 41 to 43 is partially disposed in a corresponding one of recesses 31 to 33. In other words, as illustrated in FIG. 3, high beam lenses 41 to 43 and low beam lens 30 do not overlap in the front view. Specifically, exit face 30*b* of low beam lens 30 and exit faces 41*b* to 43*b* of high beam lenses 41 to 43 do not overlap in the front view. More specifically, in the front view, portions of the periphery of exit face 30*b*, that is, the portions forming recesses 31 to 33 substantially coincide with portions of the peripheries of exit faces 41*b* to 43*b*.

It should be noted that, as shown in FIG. 5, exit face 30*b* of low beam lens 30 is located at a position that is farther from low beam light source module 10 than exit faces 41*b* to 43*b* of high beam lenses 41 to 43 are. Stated simply, low beam lens 30 is located further forward than high beam lenses 41 to 43. For example, as illustrated in FIG. 5, entry face 30*a* of low beam lens 30 is disposed to be substantially coplanar with exit faces 41*b* to 43*b* of high beam lenses 41 to 43. Recesses 31 to 33 are formed, for example, by removing the respective forward portions of high beam lenses 41 to 43 from a portion of the substantial sphere (specifically, spherical segment: the portion surrounded by a portion of a sphere surface (i.e., spherical crown) and a plane which are obtained when the sphere is split by the plane).

As illustrated in FIG. 3, high beam lenses 41 to 43 are arranged spaced apart. The spaces may be identical or different. In this embodiment, the space between high beam lens 41 and high beam lens 42 is identical to the space between high beam lens 41 and high beam lens 43.

The three high beam lenses 41 to 43 are asymmetrically arranged in the front view.

Specifically, the three high beam lenses 41 to 43 have a top-biased arrangement relative to horizontal line 80. Specifically, high beam lens 41 and high beam lens 42 are disposed above horizontal line 80, and high beam lens 43 is disposed below horizontal line 80. It should be noted that horizontal line 80 is a horizontal line passing through the center of substantially circular exit face 30*b*.

Furthermore, the three high beam lenses 41 to 43 have a left-biased arrangement relative to vertical line 81. Specifically, high beam lens 41 and high beam lens 43 are disposed left of vertical line 81, and high beam lens 42 is disposed right of vertical line 81.

It should be noted that lighting apparatus 1 illustrated in FIG. 2 to FIG. 5 is a lighting apparatus that is used as headlight 120 on the right side (left side when viewed from the front) of vehicle body 110. In other words, when lighting apparatus 1 is attached to the right side of vehicle body 110, the three high beam lenses 41 to 43 have an arrangement biased toward the outside of vehicle body 110, that is, the right side (left side when viewed from the front) relative to vertical line 81. Conversely, when lighting apparatus 1 is attached to the left side of vehicle body 110, three high beam lenses 41 to 43 have an arrangement biased toward the outside of vehicle body 110, that is, the left side (right side when viewed from the front) relative to vertical line 81. Specifically, a lighting apparatus that is used as headlight 120 on the right side of vehicle body 110 has a shape that is the left-right (mirror) reverse of lighting apparatus 1 in FIG. 3.

Here, the three high beam lenses 41 to 43 are arranged so as not to overlap with vertical line 81. In FIG. 3, the region which is in the bottom portion of exit face 30*b* and overlaps with vertical line 81 is a region that contributes greatly in ensuring brightness when a low beam is formed. As such, when the high beam lenses are arranged to overlap with vertical line 81, there is the risk that the brightness of the low beam may be insufficient. In other words, light extraction efficiency deteriorates. On the other hand, in FIG. 3, when the high beam lenses are disposed in a region which is in the top portion of exit face 30*b* and overlapping with vertical line 81, color unevenness in the low beam occurs.

Based on the foregoing description, it is useful for high beam lenses 41 to 43 to be arranged without overlapping with vertical line 81. It should be noted that the high beam lenses may be arranged to overlap with vertical line 81 if doing so does not pose a problem to light extraction efficiency.

It should be noted that although three high beam lenses 41 to 43 are described in this embodiment, N (where N is an integer greater than or equal to 2) high beam lenses may be provided.

In this case, the centroid for the N high beam lenses may be located above horizontal line 80. Alternatively, the centroid may be located left or right of vertical line 81. For example, the number of high beam lenses in a top-biased arrangement relative to horizontal line 80 is greater than the number of high beam lenses in a bottom-biased arrangement relative to horizontal line 80. Furthermore, the number of high beam lenses in a left-biased arrangement (i.e. biased toward the outside of vehicle body 110) relative to vertical line 81 is greater than the number of high beam lenses in a right-biased arrangement (i.e. biased toward the inside of vehicle body 110) relative to vertical line 81.

SUMMARY

For example, conventionally, a set composed of a pair of the first lamp unit for short-distance illumination and the second lamp unit for long-distance illumination is disposed at each of the left and right sides of the front of the vehicle body of motor vehicle 100. In other words, since the first lamp units and the second lamp units are disposed separated from each other, a person located in the illuminated area may experience not only glare but also discomfort due to the difference in light intensity and the difference in emitted light color between the first lamp unit and the second light unit.

In response to this, lighting apparatus 1 according to this embodiment includes: low beam light source module 10 that emits a first light; low beam lens 30 that allows the first light to pass through and exit from exit face 30*b*; high beam light source module 21 that emits a second light; and high beam lens 41 that is smaller than the first lens, and allows the second light to pass through and exit from exit face 41*b*. When viewed from the exit face 30*b* side, (i) exit face 30*b* has recess 31 that is recessed inward from the periphery; and (ii) exit face 41*b* is at least partially disposed in recess 31.

In this manner, in the front view, each of exit faces 41*b* to 43*b* of high beam lenses 41 to 43 is disposed in the corresponding one of recesses 31 to 33 of exit face 30*b* of low beam lens 30. Accordingly, since exit faces 41*b* to 43*b* and exit face 30*b* are in close proximity, it becomes easier for a person located in the illuminated area to perceive lighting apparatus 1 as a single light source during long-distance illumination. Because lighting apparatus 1 can be perceived by the person as a single light source, the difference in light intensity and the difference in emitted light color are not readily noticed, and thus discomfort can be reduced. In addition, the close proximity between exit faces 41*b* to 43*b* and exit face 30*b* also allows lighting apparatus 1 to be miniaturized.

Furthermore, for example, lighting apparatus 1 includes three high beam lenses 41 to 43, and, when viewed from the exit face 30*b* side: (i) exit face 30*b* has the three recesses 31 to 33; and (ii) each of the three high beam lenses 41 to 43 is at least partially disposed in the corresponding one of the three recesses 31 to 33.

Accordingly, the function of forming a high beam can be divided among the plural high beam lenses 41 to 43. Therefore, it is possible to illuminate at the required brightness stipulated under regulations, etc., while suppressing power consumption.

Furthermore, for example, the three high beam lenses 41 to 43 are arranged spaced apart.

This improves the degree of freedom for the layout of the plural high beam lenses 41 to 43, and is also advantageous from an aesthetic standpoint.

Furthermore, for example, when viewed from the exit face 30*b* side, the three high beam lenses 41 to 43 are arranged asymmetrically.

This improves the degree of freedom for the layout of the plural high beam lenses 41 to 43, and is also advantageous from an aesthetic standpoint.

Furthermore, for example, when viewed from the exit face 30*b* side: (i) exit face 30*b* is substantially circular; and (ii) the three high beam lenses 41 to 43 have a top-biased arrangement relative to horizontal line 80 passing through the center of exit face 30*b*.

Accordingly, since the plural high beam lenses 41 to 43 have an arrangement biased toward the upper portion of exit face 30*b*, it is possible to secure a large area for the lower central portion of exit face 30*b* of low beam lens 30, which contributes significantly to ensuring the brightness required in forming a low beam. Therefore, deterioration of light extraction efficiency from low beam lens 30 can be suppressed.

Furthermore, for example, when viewed from the exit face 30*b* side: (i) exit face 30*b* is substantially circular; and (ii) the three high beam lenses 41 to 43 have a left-biased or right-biased arrangement relative to horizontal line 81 passing through the center of exit face 30*b*.

Accordingly, since the plural high beam lenses 41 to 43 have an arrangement biased toward the left or right of exit face 30*b*, it is possible to secure a large area for the lower central portion of exit face 3*bb* of low beam lens 30. Therefore, deterioration of light extraction efficiency from low beam lens 30 can be suppressed.

Furthermore, for example, when lighting apparatus 1 is attached to the left side or the right side of the front of vehicle body 110, the three high beam lenses 41 to 43 have an arrangement biased toward the outside of vehicle body 110 relative to vertical line 81.

Accordingly, high beam lenses 41 to 43 can be disposed closer to the outside of vehicle body 110, which improves the degree of layout freedom, and is also advantageous from an aesthetic standpoint.

Furthermore, for example, when viewed from the first exit face side: (i) the exit face 30*b* is substantially circular; (ii) the two high beam lenses 41 and 42 are disposed above horizontal line 80; (iii) the two high beam lenses 41 and 43 are disposed left or right of vertical line 81; and (iv) the three high beam lenses 41 to 43 are arranged spaced apart.

Accordingly, as described above, since exit faces 41*b* to 43*b* and exit face 30*b* be are in close proximity, it becomes easier for a person located in the illuminated area to perceive lighting apparatus 1 as a single light source during long-distance illumination. Because lighting apparatus 1 can be perceived by the person as a single light source, the difference in light intensity and the difference in emitted light color are not readily noticed, and thus discomfort can be reduced. Furthermore, the close proximity between exit faces 41*b* to 43*b* and exit face 30*b* also allows lighting apparatus 1 to be miniaturized.

Furthermore, for example, exit face 30*b* is disposed at a position that is farther from the light sources than exit faces 41*b* to 43*b* are.

Accordingly, for example, entry face 30*a* of low beam lens 30 and exit faces 41*b* to 43*b* of the plural high beam lenses 41 to 43 can be made substantially coplanar. Accordingly, it is possible to prevent light exiting from the plural high beam lenses 41 to 43 from entering entry face 30*a* of low beam lens 30. Therefore, what is called leak light can be suppressed, and light extraction efficiency can be improved.

Furthermore, for example, (i) low beam lens 30 and (ii) high beam lenses 41 to 43 are separately formed.

Here, in order to improve light extraction efficiency, low beam lens 30 and the plural high beam lenses 41 to 43 are disposed according to different reference points. Specifically, low beam lens 30 is disposed to have a suitable distance from low beam light source module 10, and each of high beam lenses 41 to 43 are disposed to have a suitable distance a suitable distance from the corresponding one of low beam light source modules 21 to 23. Here, since (i) low beam lens 30 and (ii) the plural high beam lenses 41 to 43 are separately formed, each can be easily disposed at the desired location.

Furthermore, for example, low beam light source module 10 emits light for near-distance illumination, and high beam light source modules 21 to 23 emit light for long-distance illumination.

Accordingly, lighting apparatus 1 can be used as a vehicle lighting apparatus.

For example, motor vehicle 100 according to this embodiment includes lighting apparatuses 1 and vehicle body 110 on the front of which light apparatuses 1 are disposed.

Accordingly, as described above, since exit faces 41*b* to 43*b* and exit face 30*b* are in close proximity, it becomes easier for a person located in the illuminated area to perceive each lighting apparatus 1 as a single light source during long-distance illumination. Because lighting apparatus 1 can be perceived by the person as one light source, the difference in light intensity and the difference in emitted light color are not readily noticed, and thus discomfort can be reduced. Furthermore, the close proximity between exit faces 41*b* to 43*b* and exit face 30*b* also allows lighting apparatus 1 to be miniaturized.

Embodiment 2

Next, a lighting apparatus according to Embodiment 2 of the present disclosure is described using FIG. 6 to FIG. 9. In Embodiment 2, description shall be focused on the points of difference from Embodiment 1, and there are instances where description of identical points is omitted.

Figure 6:
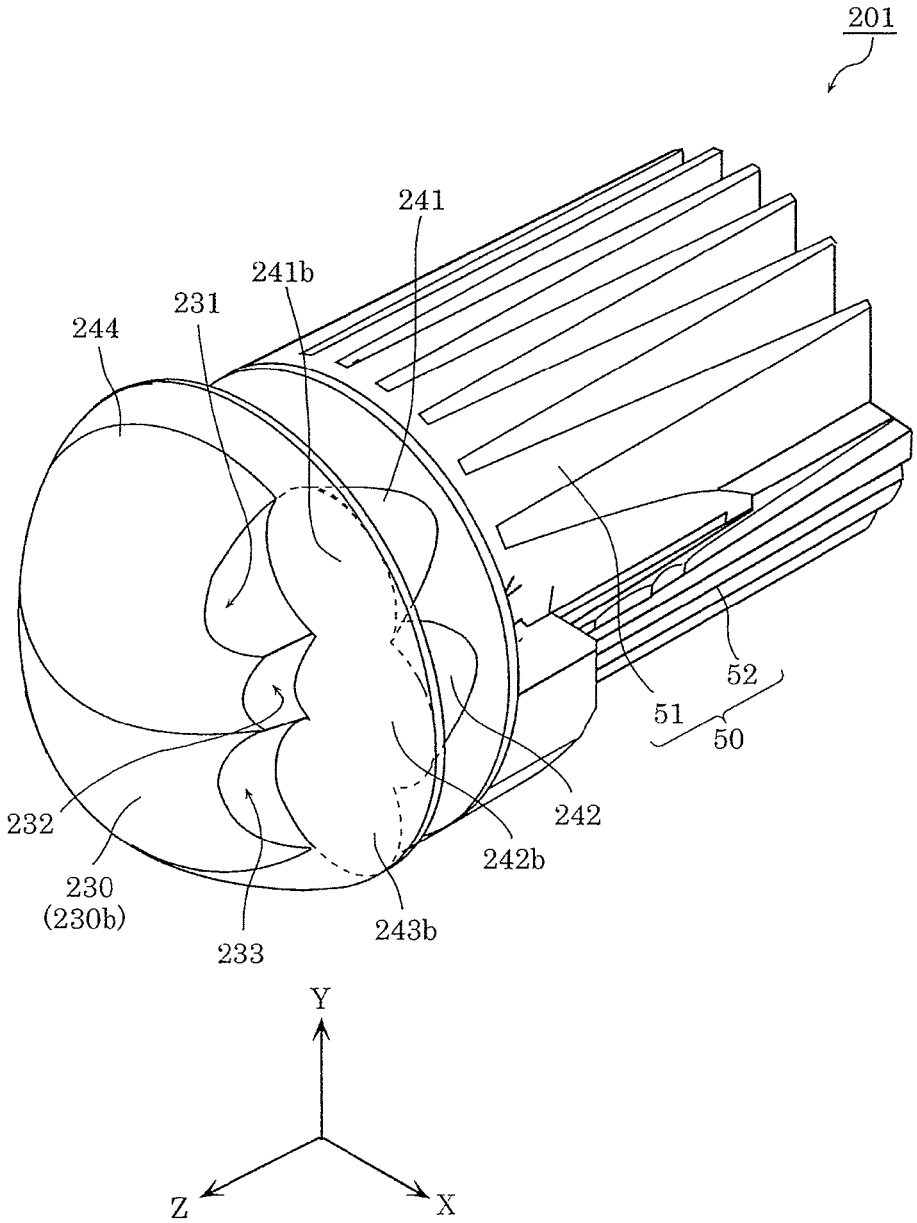
FIG. 6 is an outline perspective view of a lighting apparatus according to Embodiment 2 of the present disclosure.
Figure 7:
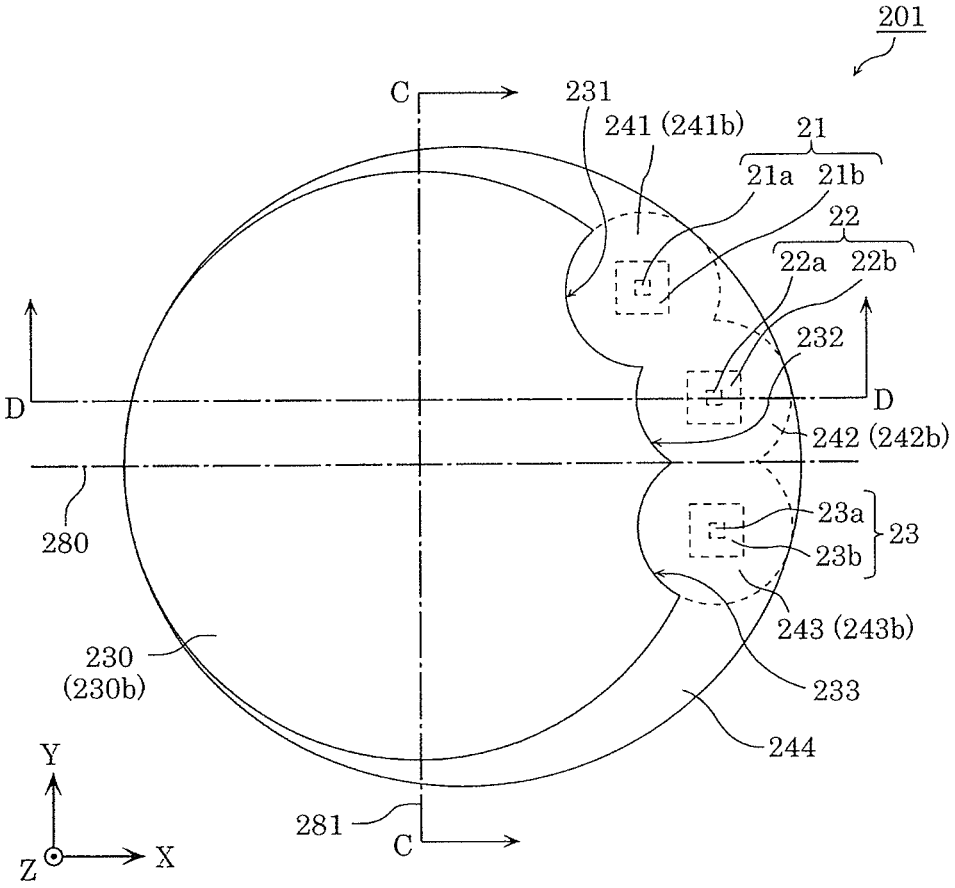
FIG. 7 is a front view of the lighting apparatus according to Embodiment 2 of the present disclosure.
Figure 8:
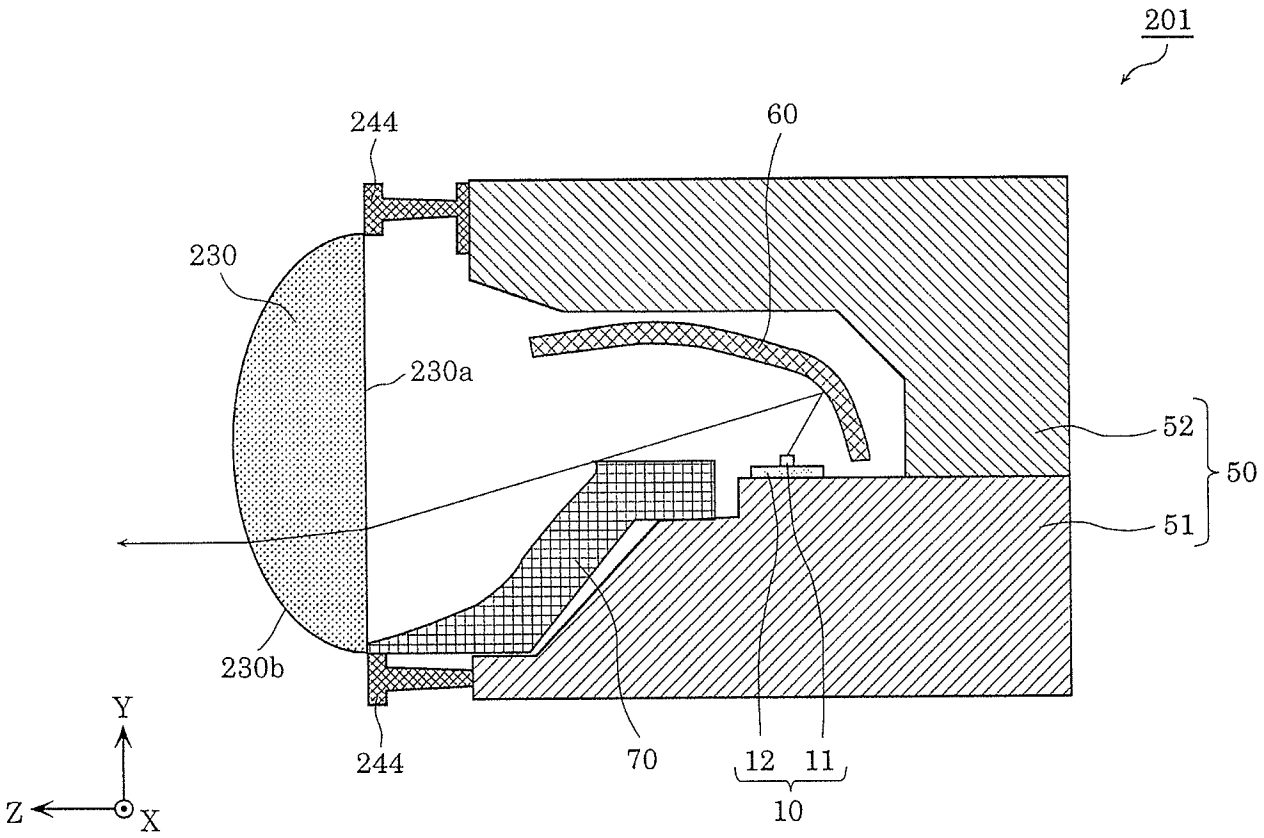
FIG. 8 is a cross-sectional view of the lighting apparatus according to Embodiment 2, taken along line C-C in FIG. 7.
Figure 9:
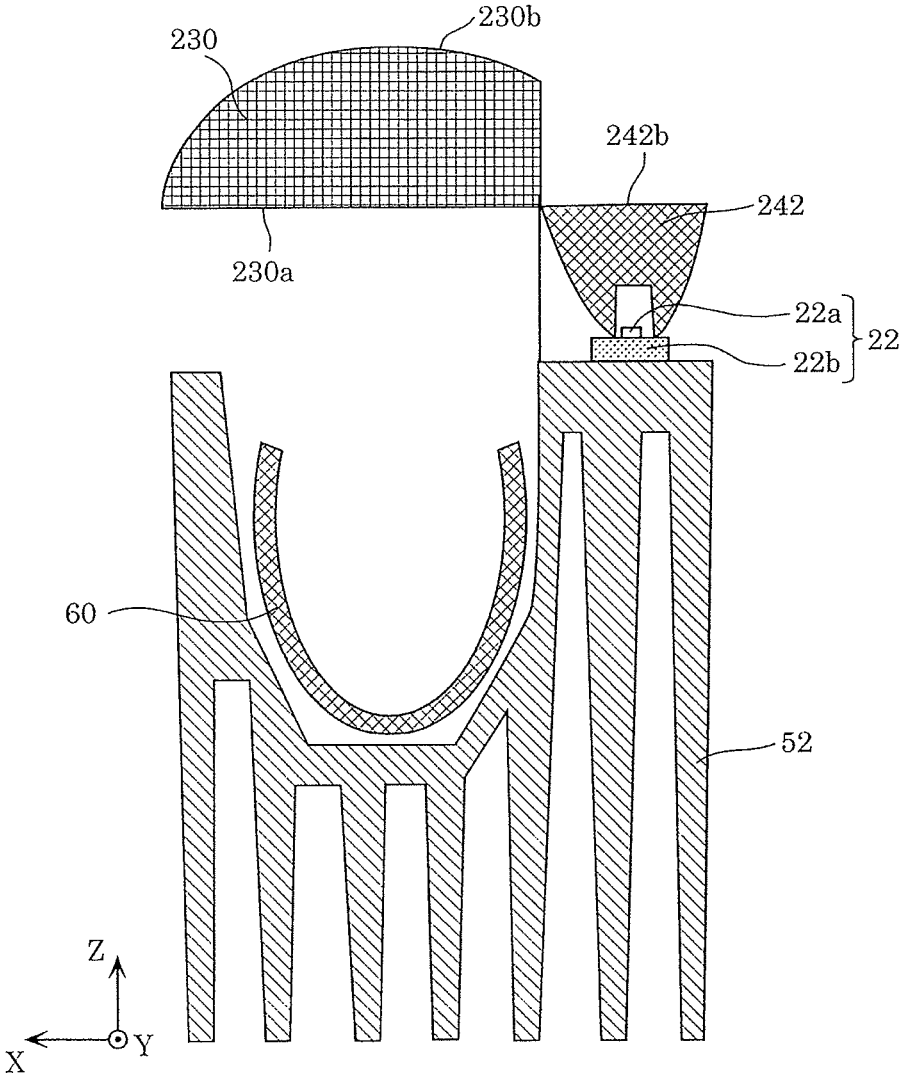
FIG. 9 is a cross-sectional view of the lighting apparatus according to Embodiment 2, taken along line D-D in FIG. 7.

FIG. 6 is an outline perspective view of lighting apparatus 201 according to this embodiment. FIG. 7 is front view of lighting apparatus 201 according to this embodiment. FIG. 8 is a cross-sectional view of lighting apparatus 201 according to this embodiment, taken along line C-C in FIG. 7. FIG. 9 is a cross-sectional view of lighting apparatus 201 according to this embodiment, taken along line D-D in FIG. 7.

As illustrated in FIG. 6 to FIG. 9, lighting apparatus 201 according to this embodiment is different compared to lighting apparatus 1 according to Embodiment 1 in including low beam lens 230 and three high beam lenses 241 to 243 in place of low beam lens 30 and high beam lenses 41 to 43. Description shall be carried out below focusing on low beam lens 230 and high beam lenses 241 to 243.

It should be noted that, although the arrangement of high beam light source modules 21 to 23 is also different from that in Embodiment 1, other than the arrangement, everything else is the same as in Embodiment 1 so description shall be omitted.

[Low Beam Lens]

Low beam lens 230 is an example of a first lens that allows light emitted from low beam light source module 10 to pass through and exit from exit face 230*b* (first exit face). Low beam lens 230 has a different shape compared to low beam lens 30 according to Embodiment 1. Everything other than the shape is the same as in Embodiment 1.

Specifically, as illustrated in FIG. 7, the shape of exit face 230*b* of low beam lens 230 is different from that in Embodiment 1. The shape of exit face 230 is substantially circular in the front view. Exit face 230*b* has three recesses 231 to 233. The three recesses 231 to 233 are recessed inward from the periphery of exit face 230*b*.

The three recesses 231 to 233 are arranged consecutively. Specifically, portions corresponding to the arc of substantially circular exit face 230*b* are not present between the three recesses 231 to 233.

The positional relationship between low beam lens 230 and high beam lenses 241 to 243 will be described later.

[High Beam Lens]

Each of high beam lenses 241 to 243 is smaller than low beam lens 230, and is an example of a second lens that allows light emitted from a corresponding one of high beam light source modules 21 to 23 to pass through and exit from a corresponding on of exit faces 241*b* to 243*b* (second exit faces). High beam lenses 241 to 243 correspond to and are positioned in front of high beam light source modules 21 to 23, respectively.

High beam lenses 241 to 243 have a different shape compared to high beam lenses 41 to 43 in Embodiment 1. Everything other than their shape is the same as in Embodiment 1. Specifically, as illustrated in FIG. 7, the consecutive arrangement of high beam lenses 241 to 243 is a point of difference from high beam lenses 41 to 43 in Embodiment 1.

High beam lenses 241 to 243 have exit faces 241*b* to 243*b*, respectively. Exit faces 241*b* to 241*b* are the forward end faces of high beam lenses 241 to 243, respectively, and are, for example, flat as illustrated in FIG. 9. As illustrated in FIG. 7, the plan view shape of each of exit faces 241*b* to 243*b* is substantially circular, and portions thereof are connected. In other words, exit faces 241*b* to 243*b* are three substantially circular shapes with adjacent ones of the substantial circles partially overlapping each other.

High beam lenses 241 to 243 are integrally formed. At this time, flange 244 is connected to integrally formed high beam lenses 241 to 243. Flange 244 is integrally formed with high beam lenses 241 to 243 so as to be coplanar with exit faces 241*b* to 243*b* of high beam lenses 241 to 243.

As illustrated in FIG. 7, flange 244 is formed to cover the periphery of low beam lens 230 and the peripheries of high beam lenses 241 to 243 so that recesses and protrusions are not formed in the front view shape of lighting apparatus 201. Specifically, in order for the front view shape of lighting apparatus 201 to be substantially elliptical, the periphery of flange 244 is substantially elliptical in shape.

Furthermore, flange 244 serves to position the three high beam lenses 241 to 243. Specifically, as illustrated in FIG. 8, flange 244 is fixed to second heat sink 52 (or high beam light source modules 21 to 23). By designing the front-back direction (Z-axis direction) length of flange 244 to a desired value before hand, the distance between the three high beam lenses 241 to 243 and high beam light source modules 21 to 23 can easily be set to the suitable value.

[Lens Arrangement]

Next, the positional relationship between low beam lens 230 and high beam lenses 241 to 243 according to this embodiment is described with reference to FIG. 7 and FIG. 9.

Compared to high beam lenses 41 to 43 in Embodiment 1, the arrangement of high beam lenses 241 to 243 is different in terms of the front view arrangement. Aside from the front view arrangement, the arrangement of the high beam lenses is the same as in Embodiment.

For example, each of high beam lenses 241 to 243 is partially disposed in a corresponding one of recesses 231 to 233. In other words, as illustrated in FIG. 7, high beam lenses 241 to 243 and low beam lens 230 do not overlap in the front view. Furthermore, as illustrated in FIG. 8, low beam lens 230 is located further forward than high beam lenses 241 to 243.

As illustrated in FIG. 7, high beam lenses 241 to 243 are arranged consecutively. In other words, high beam lenses 241 to 243 are arranged so that exit faces 241*b* to 243*b* are arranged consecutively. Specifically, the front view shape of exit faces 241*b* to 243*b* is that of three substantially circular shapes in which adjacent ones of the substantial circles partially overlap each other.

Furthermore, the three high beam lenses 241 to 243 are asymmetrically arranged in the front view.

Specifically, the three high beam lenses 241 to 243 have a top-biased arrangement relative to horizontal line 280. Specifically, high beam lens 241 and high beam lens 242 are disposed above horizontal line 280, and high beam lens 243 is disposed below horizontal line 280. It should be noted that horizontal line 280 is a horizontal line that passes through the center of substantially circular exit face 230*b*.

Furthermore, the three high beam lenses 241 to 243 have a right-biased arrangement relative to vertical line 281. Specifically, the three high beam lenses 241 to 243 are disposed right of vertical line 281.

It should be noted that lighting apparatus 201 illustrated in FIG. 6 to FIG. 9 is a lighting apparatus that is used as headlight 120 on the left side (right side in the front view) of vehicle body 110. In other words, when lighting apparatus 201 is attached to the left side of vehicle body 110, the three high beam lenses 241 to 243 have an arrangement biased toward the outside of vehicle body 110, that is, the left side (right side in the front view) relative to vertical line 281. Conversely, when lighting apparatus 201 is attached to the right side of vehicle body 110, the three high beam lenses 241 to 243 have an arrangement biased toward the outside of vehicle body 110, that is, the right side (left side in the front view) relative to vertical line 281. Specifically, a lighting apparatus that is used as headlight 120 on the right side of vehicle body 110 has a shape that is the left-right (mirror) reverse of lighting apparatus 201 in FIG. 7.

Here, the three high beam lenses 241 to 243 are arranged so as not to overlap with vertical line 281. Accordingly, light extraction efficiency can be improved as in Embodiment 1.

It should be noted that although three high beam lenses 241 to 243 are described in this embodiment, N (where N is an integer greater than or equal to 2) high beam lenses may be provided.

In this case, the centroid for the N high beam lenses may be located above horizontal line 280. Alternatively, the centroid may be located left or right of vertical line 281. For example, the number of high beam lenses in a top-biased arrangement relative to horizontal line 280 is greater than the number of high beam lenses in a bottom-biased arrangement relative to horizontal line 280. Furthermore, the number of high beam lenses in a left-biased arrangement (i.e., biased toward the outside of vehicle body 110) relative to vertical line 281 is greater than the number of high beam lenses in a right-biased arrangement (i.e., biased toward the inside of vehicle body 110) relative to vertical line 281.

For example, although the two high beam lenses 241 and 242 are provided above horizontal line 280 in this embodiment, all three of high beam lenses 241 to 243 may be provided above horizontal line 280. Furthermore, although high beam lens 242 is provided above horizontal line 280, a portion of high beam lens 242 may be provided below horizontal line 280.

SUMMARY

As described above, in lighting apparatus 201 according to this embodiment, the three high beam lenses 241 to 243 are arranged consecutively.

Accordingly, since the plural high beam lenses 241 to 243 are provided consecutively, exit faces 241*b* to 243*b* of the plural high beam lenses 241 to 243 can be provided connected to one another. Therefore, exit faces 241*b* to 243*b* of the plural high beam lenses 241 to 243 and exit face 230*b* of low beam lens 230 can be placed in close proximity, and thus the discomfort imparted to a person located in the illuminated area can be reduced. Furthermore, since exit faces 241*b* to 243*b* are connected to one another, lighting apparatus 201 can be further miniaturized. In addition, this is also advantageous from the aesthetic standpoint.

Furthermore, for example, the three high beam lenses 241 to 243 are integrally formed.

Accordingly, since the plural high beam lenses 241 to 243 are integrally formed, the plural high beam lenses 241 to 243 can be easily formed by injection molding using a resin material, for example. In addition, since the plural high beam lenses 241 to 243 are integrally formed, assembly is also simplified, and the manufacturing cost of lighting apparatus 201 can be reduced.

Furthermore, for example, when viewed from the exit face 30*b* side, (i) exit face 30*b* is substantially circular; (ii) the three high beam lenses 241 to 243 disposed left or right of vertical line 281; (iii) the two high beam lenses 241 and 242 are disposed above horizontal line 280; and (iv) the three high beam lenses 241 to 243 are arranged consecutively.

Accordingly, as described above, exit faces 241*b* to 243*b* of the plural high beam lenses 241 to 243 and exit face 230*b* of low beam lens 230 can be placed in close proximity, and thus the discomfort imparted to a person located in the illuminated area can be reduced. Furthermore, since exit faces 241*b* to 243*b* are connected to one another, lighting apparatus 201 can be further miniaturized. In addition, this is also advantageous from the aesthetic standpoint.

[Others]

Although the lighting apparatus according to the present disclosure is described thus far based on exemplary embodiments and variations thereof, the present disclosure is not limited to the exemplary embodiments.

For example, although examples including three high beam lenses are described in the foregoing embodiments, the present disclosure is not limited to this configuration. For example, N (where N is an integer greater than or equal to 2) high beam lenses may be included, as described above. In other words, it is acceptable to have only two high beam lenses or four or more high beam lenses. Alternatively, it is acceptable to have only one high beam lens.

Furthermore, although the foregoing embodiments describe an example in which exit face 30*b* of low beam lens 30 is located further forward than exit face 41*b* of high beam lens 41, the present disclosure is not limited to such configuration. For example, the exit face of the low beam lens may be continuous with the exit face of the high beam lenses.

Figure 10:
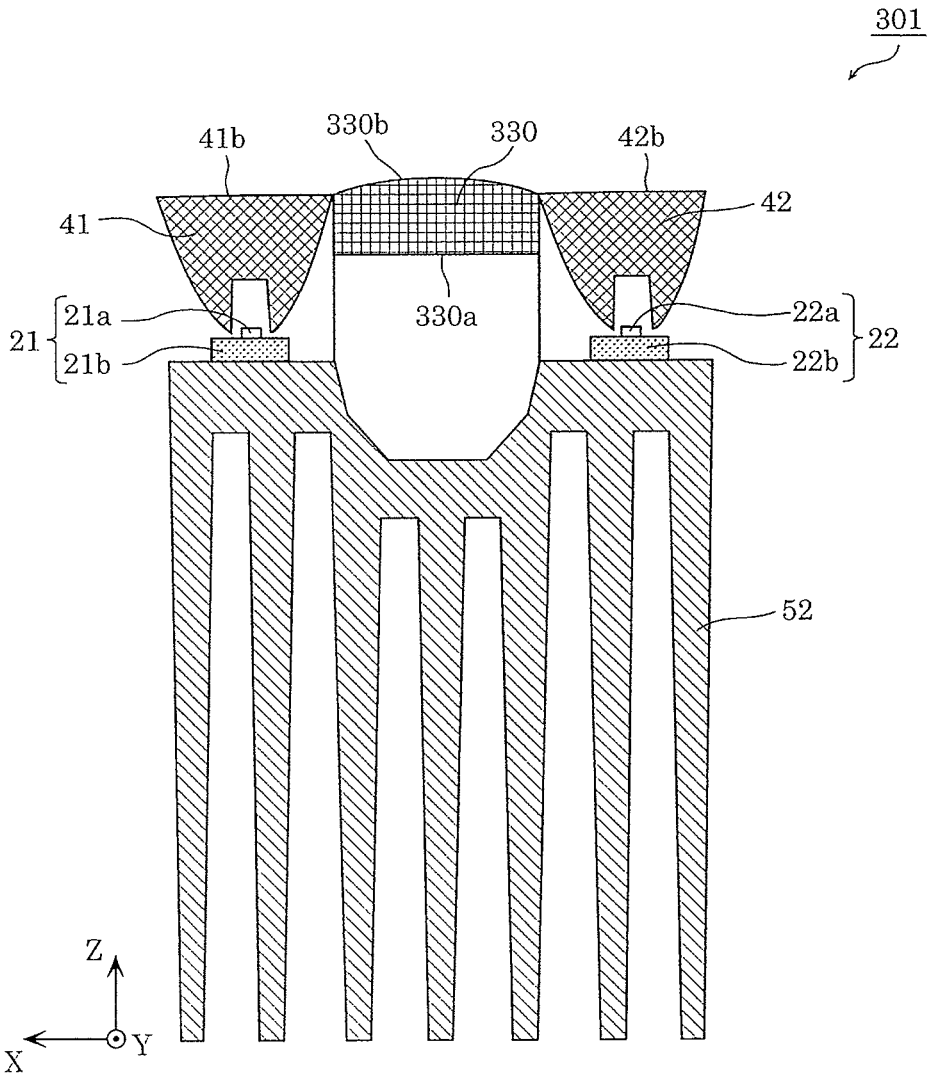
FIG. 10 is a cross-sectional view of a lighting apparatus according to a variation of an embodiment of the present disclosure.

FIG. 10 is a cross-sectional view (equivalent to a cross-sectional view taken along line A-A in FIG. 3) of lighting apparatus 301 according to a variation of an embodiment of the present disclosure. In lighting apparatus 301 illustrated in FIG. 10, exit face 330*b* of low beam lens 330 is continuous with exit faces 41*b* and 42*b* of high beam lenses 41 and 42, respectively. In other words, there is no difference in level between exit face 330*b* and exit faces 41*b* and 42*b*, and exit face 330*b* and exit faces 41*b* and 42*b* are, for example, substantially coplanar.

Accordingly, it is possible to prevent light exiting from the plural high beam lenses 41 to 43 from entering entry face 330*a* of low beam lens 330. Therefore, what is called leak light can be suppressed, and light extraction efficiency can be improved.

Furthermore, although the foregoing embodiments describe an example in which low beam lens 30 and high beam lenses 41 to 43 are configured as separate bodies, the present disclosure is not limited to such configuration. For example, the low beam lens and the high beam lenses may be integrally formed.

Accordingly, since the low beam lens and the high beam lenses are integrally formed, the low beam lens and the high beam lenses can be easily formed by injection molding using a resin material, for example. In addition, since the low beam lens and the high beam lenses are integrally formed, assembly is also simplified, and the manufacturing cost of the lighting apparatus can be reduced.

Furthermore, although the foregoing embodiments describe an example in which high beam light source modules 21 to 23 are configured as separate bodies, the present disclosure is not limited to such configuration. High beam light source modules 21 to 23 may be integrated. Specifically, the plural high beam light-emitting elements 21*a* to 23*a* may be mounted on a single board. In particular, when high beam lenses 241 and 243 are arranged consecutively as in Embodiment 2, the configuration of the high beam light source modules can be simplified.

Furthermore, although the foregoing embodiments describe top-biased or left/right-biased arrangements as examples of high beam lenses 41 to 43 being asymmetrically arranged in the front view, the present disclosure is not limited to such configurations. For example, high beam lenses 41 to 43 need not be point symmetrical; rotationally symmetrical, or line symmetrical with respect to the center or a line passing through the center of exit face 30*b* of low beam lens 30.

Furthermore, although the foregoing embodiments describe an example in which motor vehicle 100 includes two lighting apparatuses 1 (headlights 120), the present disclosure is not limited to such configuration. For example, motor vehicle 100 may include three or more of lighting apparatus 1, such as having two lighting apparatuses 1 on each of the left and right sides of vehicle body 110, or motor vehicle 100 may include only a single lighting apparatus 1.

For example, although the foregoing embodiments describe an example in which the lighting apparatus is applied to a headlight that emits a low beam and a high beam, the lighting apparatus may be applied to a headlight for use as a fog lamp or a daytime running light (DRL).

Furthermore, although the light-emitting elements are exemplified by LEDs in the foregoing embodiments, semiconductor light-emitting element such as semiconductor lasers, or light-emitting elements such as organic electro luminescence (EL) or non-organic EL elements may be used.

Furthermore, although motor vehicle 100 is exemplified by a four-wheeled motor vehicle in the foregoing embodiments, other motor vehicles such as a two-wheeled motor vehicle may be used.

Forms obtained by various modifications to the respective exemplary embodiments that can be conceived by a person of skill in the art as well as forms realized by arbitrarily combining structural components and functions in the respective exemplary embodiments which are within the scope of the essence of the present disclosure are included in the present disclosure.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting apparatus comprising:

a first light source that emits a first light;

a first lens that allows the first light to pass through and exit from a first exit face of the first lens;

a second light source that emits a second light; and a second lens that is smaller than the first lens and allows the second light to pass through and exit from a second exit face of the second lens, wherein, when viewed from a first exit face side:

(i) the first exit face has a recess that is recessed inward from a periphery of the first exit face;

(ii) the second exit face is at least partially disposed in the recess; and (iii) a portion of the periphery of the first exit face which forms the recess coincides with a portion of a periphery of the second exit face.

2. The lighting apparatus according to claim 1, comprising

N of the second lenses, where N is an integer greater than or equal to 2, wherein, when viewed from the first exit face side:

(i) the first exit face has N of the recesses; and (ii) each of the N second lenses is at least partially disposed in a corresponding one of the N recesses.

3. The lighting apparatus according to claim 2, wherein the N second lenses are arranged spaced apart.

4. The lighting apparatus according to claim 2,
wherein the N second lenses are arranged consecutively.

5. The lighting apparatus according to claim 4,
wherein the N second lenses are integrally formed.

6. The lighting apparatus according to claim 2,
wherein, when viewed from the first exit face side, the N second lenses are arranged asymmetrically.

7. The lighting apparatus according to claim 6,
wherein, when viewed from the first exit face side:
(i) the first exit face is substantially circular; and
(ii) the N second lenses have a top-biased arrangement relative to a horizontal line passing through a center of the first exit face.

8. The lighting apparatus according to claim 6,
wherein, when viewed from the first exit face side:
(i) the first exit face is substantially circular; and
(ii) the N second lenses have a left-biased or right-biased arrangement relative to a vertical line passing through a center of the first exit face.

9. The lighting apparatus according to claim 8,
wherein, when the lighting apparatus is attached to a left side or a right side of a front of a vehicle body, the N second lenses have an arrangement biased toward an outside of the vehicle body relative to the vertical line.

10. The lighting apparatus according to claim 2,
wherein N is three, and
when viewed from the first exit face side:
(i) the first exit face is substantially circular;
(ii) two of the three second lenses are disposed above a horizontal line passing through a center of the first exit face;
(iii) two of the three second lenses are disposed left or right of a vertical line passing through the center of the first exit face; and
(iv) the three second lenses are arranged spaced apart.

11. The lighting apparatus according to claim 2,
wherein N is three, and
when viewed from the first exit face side:
(i) the first exit face is substantially circular;
(ii) the three second lenses are disposed left or right of a vertical line passing through a center of the first exit face;
(iii) two of the three second lenses are disposed above a horizontal line passing through the center of the first exit face; and
(iv) the three second lenses are arranged consecutively.

12. The lighting apparatus according to claim 1,
wherein the first exit face is disposed at a position that is farther from the first light source than the second exit face is.

13. The lighting apparatus according to claim 1,
wherein the first exit face is continuous with the second exit face.

14. The lighting apparatus according to claim 1,
wherein the first lens and the second lens are separately formed.

15. The lighting apparatus according to claim 1,
wherein the first lens and the second lens are integrally formed.

16. The lighting apparatus according to claim 1,
wherein the first light source emits the first light for short-distance illumination, and
the second light source emits the second light for long-distance illumination.

17. A motor vehicle comprising:
the lighting apparatus according to claim 1; and
a vehicle body in a front of which the lighting apparatus is disposed.

18. A lighting apparatus comprising:
a first light source that emits a first light;
a first lens that allows the first light to pass through and exit from a first exit face of the first lens;
a second light source that emits a second light; and
N second lenses that are smaller than the first lens and allow the second light to pass through and exit from a second exit face of each of the N second lenses, where N is an integer greater than or equal to 2,
wherein, when viewed from a first exit face side:
(i) the first exit face has N recesses that are recessed inward from a periphery of the first exit face; and
(ii) the second exit face of each of the N second lenses is at least partially disposed in a corresponding one of the N recesses.

* * * * *